US006290582B1

(12) United States Patent
Eklund

(10) Patent No.: US 6,290,582 B1
(45) Date of Patent: Sep. 18, 2001

(54) SHARPENING DEVICE

(75) Inventor: Tore Eklund, Motala (SE)

(73) Assignee: Telefonaktiebolaget LM Ericsson, Stockholm (SE)

( * ) Notice: Subject to any disclaimer, the term of this patent is extended or adjusted under 35 U.S.C. 154(b) by 0 days.

(21) Appl. No.: 09/485,916

(22) PCT Filed: Aug. 18, 1998

(86) PCT No.: PCT/SE98/01489

§ 371 Date: Feb. 16, 2000

§ 102(e) Date: Feb. 16, 2000

(87) PCT Pub. No.: WO99/11428

PCT Pub. Date: Mar. 11, 1999

(30) Foreign Application Priority Data

| | | |
|---|---|---|
| Aug. 18, 1997 | (SE) | 9702982 |
| Sep. 8, 1997 | (SE) | 9703235 |
| Apr. 6, 1998 | (SE) | 9801191 |

(51) Int. Cl.[7] ..... B24B 3/54

(52) U.S. Cl. ..... 451/263; 451/486; 451/555

(58) Field of Search ..... 451/263, 486, 451/468, 552, 555

(56) References Cited

U.S. PATENT DOCUMENTS

| | | | | |
|---|---|---|---|---|
| 989,692 | | 4/1911 | Brower et al. . | |
| 1,909,743 | * | 5/1933 | Blankner | 451/486 |
| 2,249,218 | * | 7/1941 | Meade et al. | 451/486 |
| 2,264,065 | | 11/1941 | Broberg | 51/116 |
| 2,646,653 | | 7/1953 | Murchison | 51/111 |
| 4,672,778 | * | 6/1987 | Rieser | 451/486 |
| 5,440,953 | * | 8/1995 | Gagelhoff et al. | 451/486 X |
| 5,478,272 | * | 12/1995 | Cozzini et al. | 451/486 X |
| 5,655,959 | | 8/1997 | Juranich | 451/486 |

FOREIGN PATENT DOCUMENTS

| | | |
|---|---|---|
| 1171230 A | 1/1959 | (FR) . |
| WO 8302581 A1 | 8/1983 | (WO) . |

OTHER PUBLICATIONS

Brinkman, A., International Search Report, International Application No. PCT/SE98/01489, Dec. 2, 1998, pp. 1–3.

* cited by examiner

*Primary Examiner*—Joseph J. Hail, III
*Assistant Examiner*—Anthony Ojini
(74) *Attorney, Agent, or Firm*—Jenkens & Gilchrist A Professional Corporation

(57) ABSTRACT

The invention relates to a sharpening device for sharpening cutting edge tools and the like, comprising two sharpening elements arranged, at a distance from each other in the axial direction, for rotation on a shaft extending along a center axis common to the sharpening elements. The sharpening elements have arms extending radically outwards from the shaft, said device being characterized in that the sharpening elements are arranged relative to each other in such a way, that their respective arms are inclined towards each other so that they intersect their respective paths of rotation, the arms, then, coming from a respective of the two sharpening elements, in an alternating way.

4 Claims, 6 Drawing Sheets

SHARPENING DEVICE

FIELD OF THE INVENTION

The present invention relates to sharpening devices, and in particular to devices for sharpening tools with cutting edges, preferably knives.

HISTORY OF THE RELATED ART

There exists a variety of more or less complicated devices for sharpening knives, ranging from devices for industrial use, to devices for domestic use. The present invention relates to a sharpening device which is particularly well suited for easily and efficiently providing a sharp cutting edge on tools having such edges which, moreover, produces a predetermined edge angle, and which may be used equally well for industrial purposes, as for domestic purposes.

Even though the invention is primarily directed towards sharpening tools with cutting edges, it is appreciated that it may be used for sharpening or grinding other types of edges, e.g. edges on plates, on which there still remains rough edges after cutting operations and the like.

For manual sharpening of tools with cutting edges, everything from grinding machines with discs or belts, to simple sharpening stones for example. The sharpening machines do in this respect have the disadvantage of being difficult to operate, and demanding a certain skill, while the sharpening stones or the like, are too inefficient to be a rational alternative. Further, the fact that sharpening machines produce a plane or concave surface in the transition between the blade and the cutting edge, while the optimal shape is slightly convex, also constitutes a problem. It is also a problem, for conventional sharpening devices, to sharpen equally much on both sides of the cutting edge tool, and thus center the cutting edge.

The present invention aims at solving the above stated problems, and to provide a simple and inexpensive sharpening device, which can be used without skill.

SUMMARY OF THE INVENTION

The invention, and that, which in particular characterises it, is apparent from the appended patent claims.

The invention will be described in closer detail in the following, with reference to the appended drawings, in which,

DETAILED DESCRIPTION OF THE EXEMPLARY PREFERRED EMBODIMENT

Figure 1:
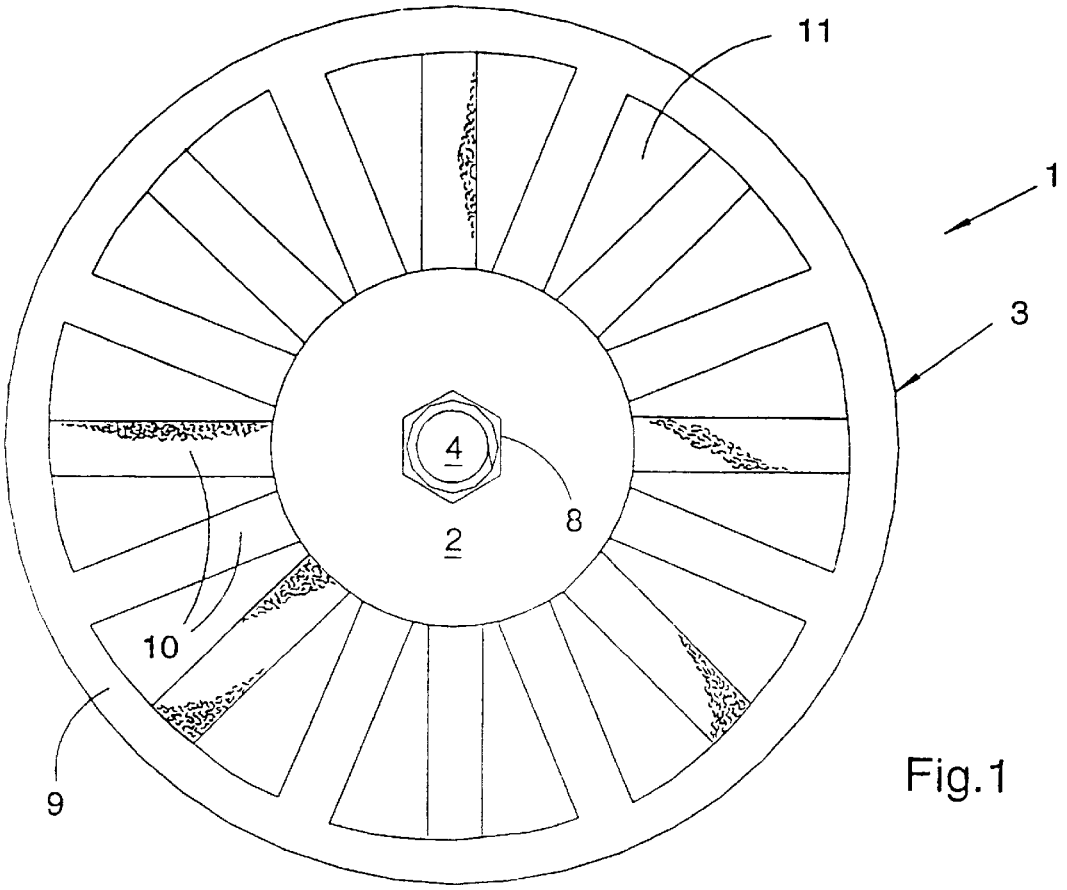
FIG. 1 is an axial view of the sharpening device according to a first embodiment of the invention.

In the first embodiment, the sharpening device 1 according to the invention is comprised of a hub 2 to which two identical sharpening members 3 are attached, and a shaft 4 extending through the hub 2.

The hub comprises three cylindrical sections 5, 6, 7 with circular cross-sections. The two outer sections 5, 7 are identical, each having an envelope, en outer end wall and an inner end wall, not shown, which is conically concave. The inner section 6 also has an envelope and two convexly conical end walls, said conicity corresponding to the conicity of the outer sections 5, 7. A concentric hole extends through all three sections 5, 6, 7, and the shaft 4 extends through said hole. The shaft 4 has, at its end, a head member 8, resting against the one end wall, and a nut 8*b* is screwed onto the shaft 4 and rests against the other end wall, whereby said three sections 5, 6, 7 may be pressed together. Outside of the threaded portion, the shaft is smooth, and adapted to be coupled to the chuck of e.g. a drilling machine or any other rotary tool.

The sharpening elements 3 are in the shown embodiment comprised of the type of material which is used for conventional abrasive discs, i.e., a sturdy sheet fibre or plastic material, which is coated on one side with an abrasive agent. In this case, the sharpening elements 3 are formed with an outer ring 9, from which radial arms 10 extend inwards towards the centre. Between the arms there are, thus, open portions 11, which means that the arms 10 of the one sharpening element 3 may be arranged in the corresponding openings 11 of the other sharpening element 3. The inner ends of the arms 10 are inserted into the conical interfaces between the inner hub section 6 and the outer hub sections 5, 7 respectively.

Figure 2:
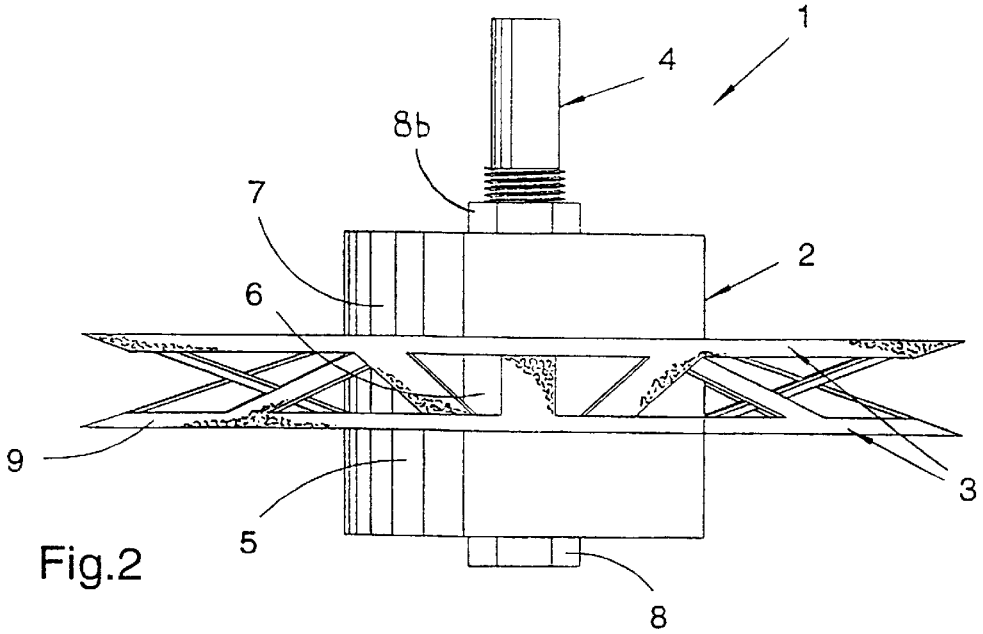
FIG. 2 is a radial view of the sharpening device in FIG. 1.
Figure 3:
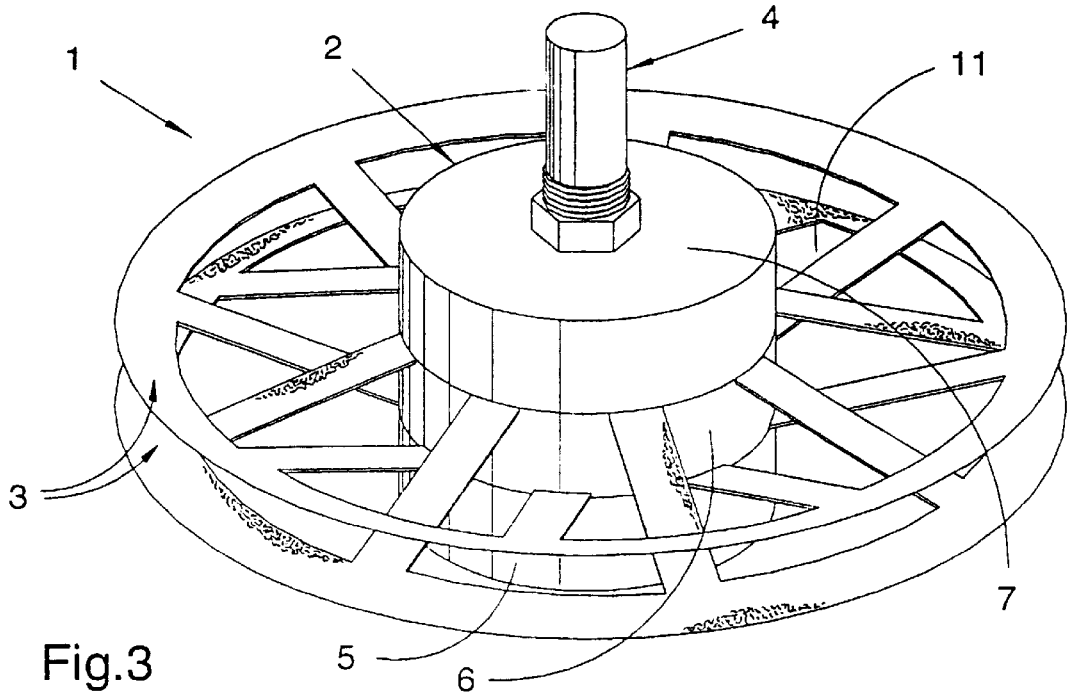
FIG. 3 is a perspective view of the sharpening device in FIG. 1.

By means of the conicity of said interfaces the arms 10 will extend "cross-wise" in an outward direction towards the outer ring 9 in a way, which can be seen in particular from FIG. 2.

When the sharpening device 1 is rotated the arms will tend to move towards a radial plane, which means that the outer rings 9 will move towards each other.

Figure 4:
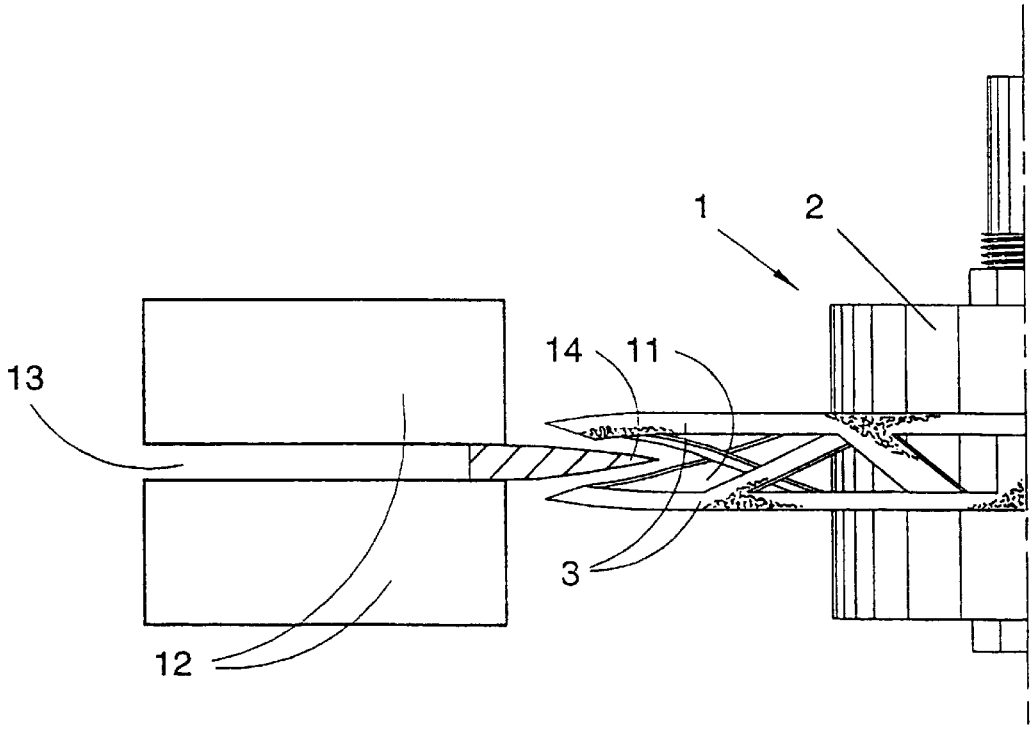
FIG. 4 is a view, partially broken away, of the sharpening device according to FIG. 2, schematically illustrating the sharpening of a cutting edge tool.

In FIG. 4, there is shown a cutting edge tool, e.g. a knife, which is inserted between the sharpening elements 3. A pair of blocks 12 is shown schematically, which act as a guiding element for guiding the tool 14 in order to secure the moving of the tool at right angles towards the shaft of the sharpening tool. The blocks 12 form between them a space 13 which is adjustable depending on the thickness of the tool 14, said characteristic of simultaneous adjustability and centering in relation to the sharpening device 1 may be conventional in nature.

When inserting the cutting edge 14 of the tool to be sharpened, between the two rotating sharpening elements 3, the arms 10 are deflected so that the above mentioned convex edge shape is produced, while the outermost edge is sharpened by the crossed arms 10 at the same time, as shown.

The sharpening device 1 according to the invention has, in the foregoing, been described and shown in what may be considered its basic form, in which it may be seen as a hand held tool, which is easily coupled to a rotating device, such as a hand held drill machine. It is, however, appreciated, that it may also be realised as a professional and independent machine with associated drives, guides and the like. Further, the sharpening elements can have differing shapes, depending on what object is to be sharpened, and to what extent and shape it is to be sharpened. The arms, which may be loose or fixed in the way shown above, can have different coatings of abrasive agent in various combinations, and they can be made of materials other than fibre or plastics, as was mentioned. In a exemplary embodiment two or more sharpening devices may be mounted side by side on a common shaft, having finer and finer abrasive agent material in successive steps.

Each sharpening device has a fixed sharpening angle, said sharpening angle being that angle which determines the cutting edge angle of the sharpened tool. The sharpening angle is dependent on the angle formed by the radial arms 10, which is best illustrated in FIGS. 2 and 4. It is thus possible to provide special sharpening devices for cutting tools demanding special cutting edge angles.

Figure 5A:
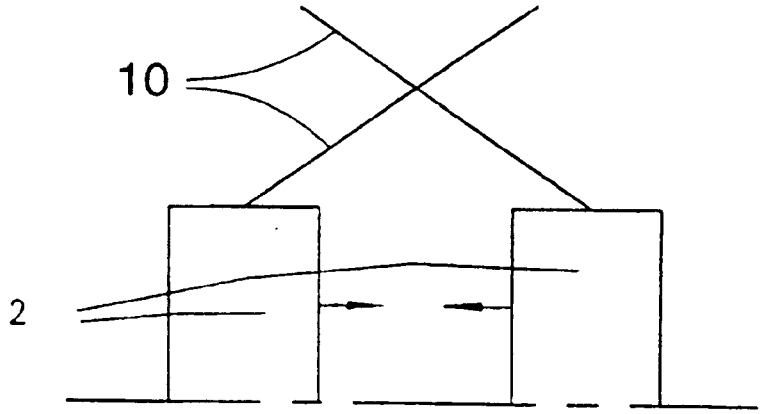
FIGS. 5*a* and 5*b* are schematic illustrations of an adjustment of the active sharpening surface in a first embodiment, in two subsequent positions.
Figure 5B:
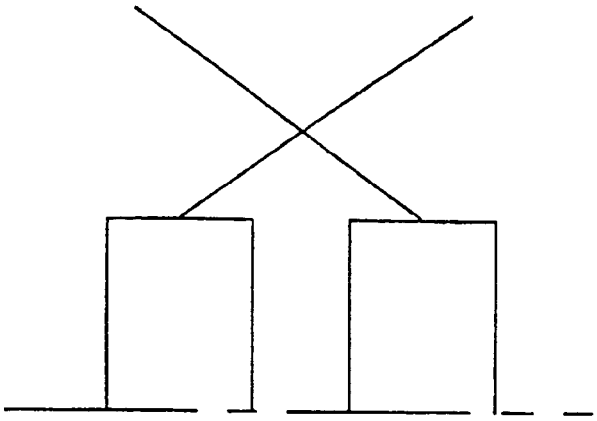

In order to provide for the use of a larger portion of the sharpening surface, the hub 2 is, in a further embodiment, comprised of two halves, which are mutually adjustable in an axial direction, and the arms 10 are, in a first position, positioned so, that a cutting tool to be sharpened may enter into sharpening engagement with said arms, only at the outer portions of the arms 10. The principle for such an axial adjustment is shown in FIGS. 5*a* and 5*b*. As a first alternative, the relative positions of the two hub-halves is adjustable by said halves being spring biased in an outward direction, in order to bring together the two sharpening elements 3. If, then, the cutting tool is brought into contact with the sharpening elements using a force which is capable of overcoming the spring bias force which urges the two halves of the hub 2 apart, the sharpening elements will be urged apart, which means that the active sharpening surface which is available for sharpening will, depending on the force with which the cutting tool is brought into contact with the sharpening elements, gradually move towards the centre of the sharpening elements. Further, spring means are arranged between the outer end walls of the hub and the head 8 of the shaft 4, and the nut 8*b* which is screwed onto the shaft, to support the return movement of the respective half of the hub 2 which results from an increase of the force by means of which the cutting tool is pressed against the sharpening device. As a second alternative, the relative positions of the two halves of the hub can be adjustable by means of mechanical guide members arranged on each of the hub halves, both of the halves and thus the sharpening elements 3 being mutually movable in an axial direction. As an example, said elements can be arranged on a respective smaller diameter portion provided on each of the hub halves. In order for the elements of the hub 2 to be movable in the axial direction in a sliding manner in relation to the shaft 4, the hub 2 and the shaft 4 are provided with complementary splines, or any other similar arrangement. In this embodiment with mutually adjustable hub halves, the sharpening elements are suitably fixedly arranged at the respective hub half.

Figure 6:
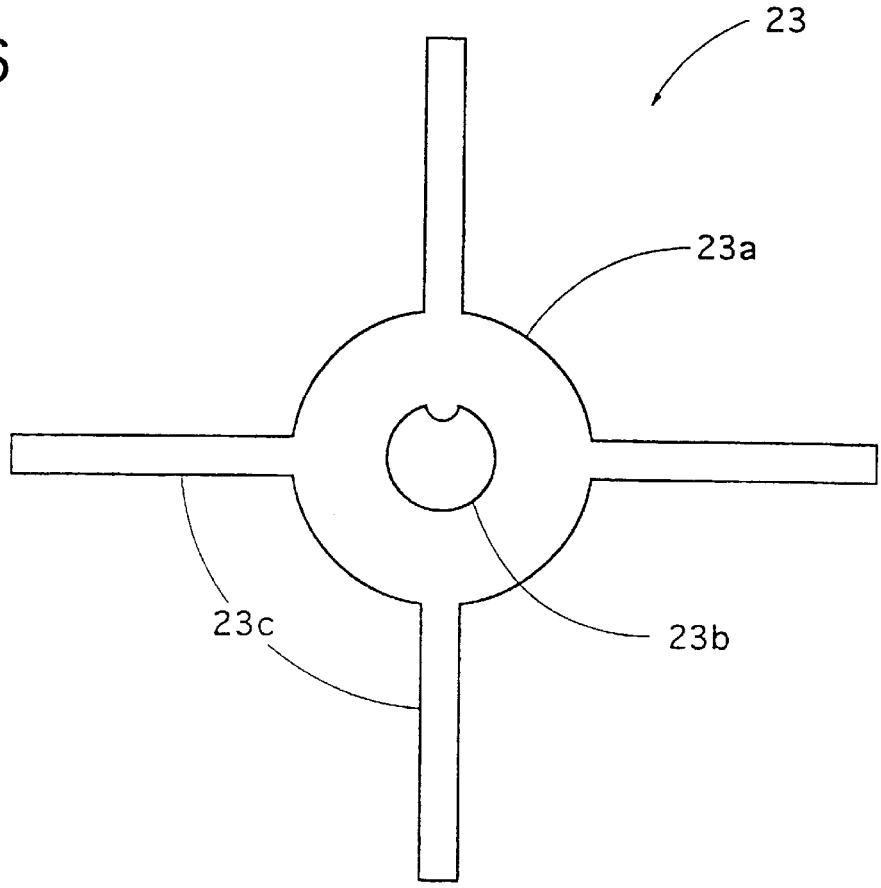
FIG. 6 is a schematic axial view of sharpening element according to a second embodiment of the invention.
Figure 7:
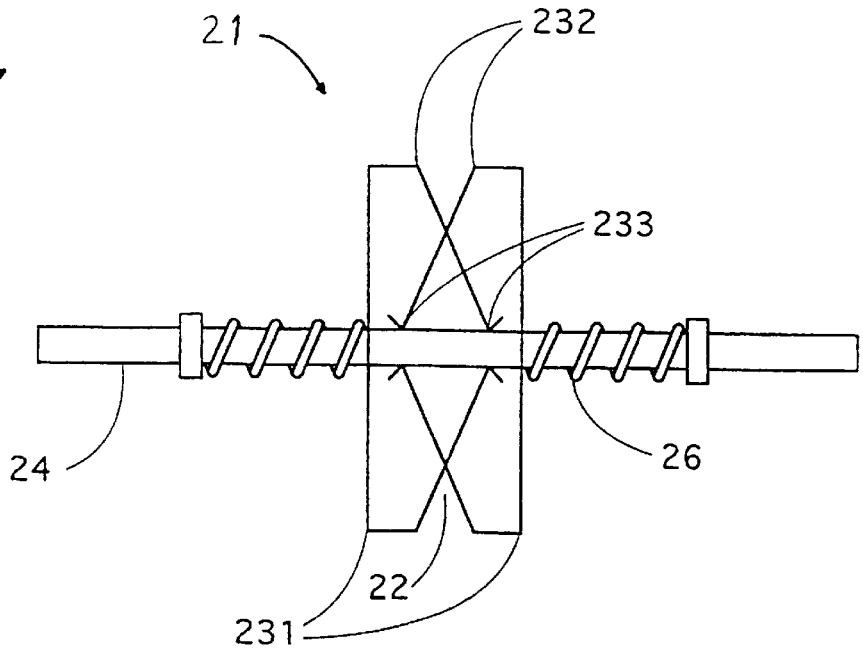
FIG. 7 is a lateral view of a sharpening device according to the present invention.

FIGS. 6 and 7 show a second embodiment of a sharpening device 21 according to the present invention. The sharpening elements 23 are in this embodiment formed from sheet metal, which has been coated with a suitable abrasive agent, and die cut, for example, to the desired shape. The sharpening element 23, the basic shape of which is shown in FIG. 6, is, as can be seen from the drawing, comprised of a central portion 23*a* which is essentially symmetric when rotated, in the centre of which a central hole 23*b* has been arranged. Said hole 23*b* is provided with a guiding protrusion, which is arranged to co-operate with a corresponding guiding arrangement, preferably in the form of a guiding groove provided on a shaft 24 on which the sharpening element is arranged. The sharpening element is further provided with sharpening arms 23*c*, the number of which can be varied, and which sharpening arms are bent to their final shape.

In FIG. 7 the sharpening elements 23 can be seen radially, from the side, and in this embodiment the arms 23*c* are bent 90° in a first bend 231 at a distance from the central portion in such a direction, that the arms of two individual sharpening elements extend towards one another. After another short distance, the arms are bent in a direction inclining downwards towards the shaft 24 in a second bend 232. The bend angle chosen for this bend will determine the sharpening angle of the tools to be sharpened by the device, as described above. In the embodiment shown, the arms terminate with a bend 233 upwards away from the shaft 24, said bend forming a surface on which the arms can move in a sliding way on the shaft 24.

The sharpening elements 23 are, as was mentioned above, arranged on the shaft 24, said shaft being provided with a guiding groove, co-operating with a corresponding guiding protrusion in the central hole of the sharpening elements 23, which allows fixing the relative positions of the sharpening elements in the direction of rotation. The sharpening elements 23 are, further, spring biased towards each other by means of spring members 26 arranged between the sharpening elements and stopping means 27, arranged on the shaft 24, in order to obtain the possibility of using the whole sharpening surface on the arms 23*c* of the sharpening elements 23, in accordance with the above stated principle. When the tool to be sharpened is pushed against the sharpening device with a moderate force, only the outer portion, in the radial direction, will be used for sharpening. If, however, the tool is pushed against the sharpening device with a larger force, this axial component of said force will, once it is large enough, overcome the biasing force of the spring members 26, pushing apart the sharpening elements 23, and the active sharpening surface will be displaced downwards on the sharpening elements 23 (see also FIG. 5 for an explanation of the principle, even though the sharpening elements are somewhat different compared to said embodiment). Preferably, the motion of the sharpening elements 23 towards one another is limited in a suitable manner, in order to secure that said sharpening elements 23, in their initial position, under the influence of the spring members 26 biasing in the direction of the sharpening surface 22 of the sharpening device 21, leave a sharpening area exposed.

Figure 8:
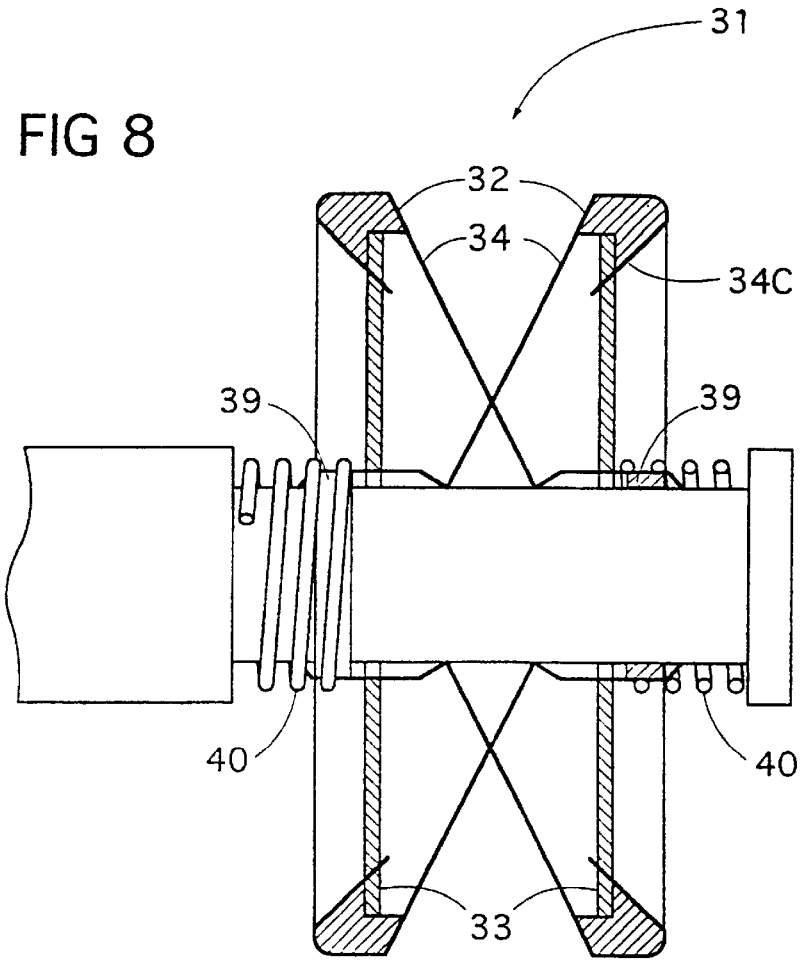
FIG. 8 is a lateral view of a sharpening device according to a third embodiment of the present invention.

In FIG. 8 a radial view, partly in section, shows a third embodiment of the sharpening device 31 according to the present invention. Here, the sharpening elements 32 are formed as two separate discs 33, onto which are fixed sharpening arms 34 made from spring steel or another suitable material. The arms 34 are, on a lower sharpening portion 34*a* coated with abrasive agent, preferably diamond, which coating is preferably carried out before the arms are bent to their final shape. An upper sharpening portion 34*b* is left without coating. In FIG. 8, for the sake of clarity, only two opposing sharpening arms 34 are shown, and the disc 33 is shown in section.

The discs 33 on which the sharpening arms 34 are mounted, are on an outer perimeter provided with recesses 33*a* for receiving the ends 34*c* of the sharpening arms 34, said arms being arranged on said perimeter with a suitable pitch, in the example shown eight sharpening arms are provided.

After being coated with abrasive agent on the surfaces to be coated, the sharpening arms are bent. In this bending operation a first bend 35, a second radiused bend 36, a third bend 37 and a fourth bend 38. The sharpening arms are then mounted on a respective of the two discs 33 by arranging a outer, bent portion 34*c* round a separate outer ring 330, and by inserting an outer end into a recess 33*a* in the disc, provided for this purpose. It is apparent, however, that the outer ring 330 need not be a separate ring, but that it may as an alternative be an integral part of the disc 33.

When all sharpening arms 34 are mounted in this manner on the discs 33, the discs are brought together, and the second, inner ends 34*d* of the sharpening arms are inserted into recesses 33*b* provided on an inner perimeter of the discs 33. When the sharpening arm ends 34*d* have all been inserted into their respective recesses 33*b,* they are mounted on a sliding ring member 39 on the outer side of the discs, after which they are bent down in a last bend 38 on the outer side of the ring member 39. Thus, the sharpening arms 34 and the discs 33 and sliding ring members 39 comprise a unit, ready to be mounted on a shaft.

Figure 9:
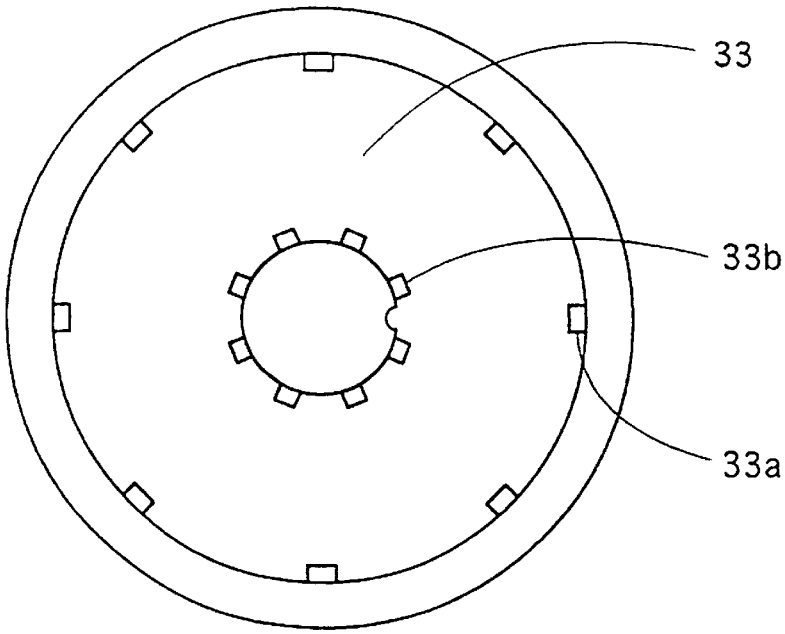
FIG. 9 is an axial view of a disc of the sharpening device in FIG. 8.
Figure 10:
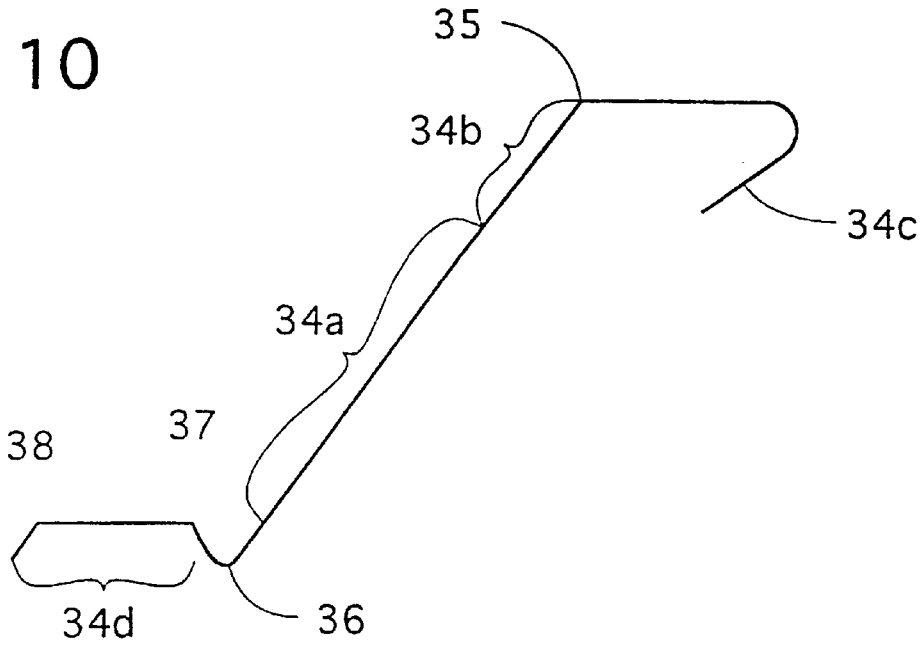
FIG. 10 is a lateral view of a bended sharpening arm according to the third embodiment of the present invention.

The sharpening device is mounted on a shaft by means of a guiding groove arrangement, a guiding protrusion of which can be seen in FIG. 9, so that the rotational position of the sharpening device on the shaft can be fixed. As is shown in FIG. 8, the sharpening arms 34 on their respective ring, are inserted under spring members 40, provided for biasing the two sharpening elements 32 towards each other. The spring members 40 and the sharpening device 31 are secured by means of screwing, after having been mounted onto the shaft.

The sharpening elements 32 are, when mounted on a shaft, spring biased towards each other. FIG. 8 shows the sharpening device in a position in which receives the load of a force applied in the radial direction from a tool (not shown) to be sharpened, so that the sharpening elements are pushed apart a short distance. The relationship between the spring load and the thickness of the material of the arms, preferably spring steel, is so determined, that the desired convex form of the cutting edge, as mentioned in the introduction, is obtained by means of a desired degree of deflection of the material of the sharpening arms.

During sharpening, the tool to be sharpened is pushed against the rotating sharpening elements 32 using a force which is able to overcome the biasing force of the spring members 40. The cutting edge of the tool will then be sharpened by the arms 34 coated with abrasive agent, and the entire lower sharpening surface 34*a* is available and can be used for sharpening. When the tool has been sharpened, it is removed from the sharpening device, and then applied against the device once again, but this time using a force which is not able to overcome the biasing spring force. The cutting edge of the tool will then rest against the upper sharpening portion 34*b* of the sharpening arms, which has not been coated with grinding material. This action will perform a whetting operation on the edge, which means that the so-called wire edge which results from the sharpening operation will be removed, when it is applied against the sharpening arms, which in this area have uncoated metal surfaces. Only the edges of the sharpening elements will act upon the previously sharpened edge. After this operation the wire edge has thus been removed, and the cutting edge is ready for use.

Since the sharpening elements 32 are spring biased, it may happen that a user applies such an excessive force, when applying the tool to be sharpened, that the sharpening elements 32 are pushed apart completely, in which position the cutting edge of the tool to be sharpened will be resting against the portions of the sharpening arms which extend from the bend 37 along the shaft. This means that the function of the sharpening device is lost. For preventing this, sensing means can be provided sensing the axial position of one or both of the sharpening elements 32. If the applied force is too large, the signal which is produced can trigger a warning signal, in the form of, for example, a sound signal or a light signal, which tells the user that the tool applying force against the sharpening device is too large. Such sound or light signals may also be used for informing a user whether the cutting edge of the tool to be cut is applied against the upper, uncoated sharpening portion 34*b* which performs the whetting of the edge. In this case, the sharpening elements are located in an initial position in which only the outer, uncoated portions of the sharpening arms 34 are exposed and available without the application of a force in the radial direction.

Thus, the present invention solves the initially stated problems, by means of sharpening device, which is as useful for industrial purposes, as it is at home. Many adaptations of the invention for numerous applications are possible, apart from those, which have already been mentioned. For example, it is possible, in the last embodiment in the description, to contemplate other bends of the arms of the sharpening element for many different purposes, and it is further possible to provide sliding bushings in the second embodiment of the invention for improved axial motion of the sharpening elements. It is of course possible to use other materials than those specifically mentioned for various applications. Such adaptations, however, lie within the scope of the present invention as defined by the appended patent claims.

What is claimed is:

1. Sharpening device for sharpening cutting edge tools, comprising two sharpening elements separated from each other in an axial direction, for rotation on a shaft extending along a centre axis which is common to the sharpening elements, said sharpening elements having arms which extend radially outwards from the shaft and are inclined towards each other in such a way as to cross each others paths of rotation, every other arm coming from a respective sharpening element in an alternating way, wherein the arms of the sharpening elements are flexible under the influence of a radially inward oriented force by means of which the cutting edge tool to be sharpened is applied against the sharpening elements during rotation thereof, and wherein the sharpening elements are spring biased towards each other.

2. Sharpening device according to claim 1, wherein the sharpening elements are attached to a hub, through which hub extends an axially extended shaft for rotation of the sharpening device, and wherein the inner ends of the arms of the sharpening elements are supported by the hub in two rows separated from each other in the axial direction, said arms being inclined in relation to each other so that the arms of the respective rows cross the arms of the other row, every other arm coming from the respective row in an alternating way.

3. Sharpening device according to claim 2, wherein the outer ends of the arms in each of the rows are interconnected by means of a ring.

4. Sharpening device according to claim 1, wherein the flexible arms impart a convex shape to the cutting edge tool.

* * * * *

UNITED STATES PATENT AND TRADEMARK OFFICE

CERTIFICATE OF CORRECTION

PATENT NO. : 6,290,582 B1
DATED : September 18, 2001
INVENTOR(S) : Tore Eklund

It is certified that error appears in the above-identified patent and that said Letters Patent is hereby corrected as shown below:

Title page,
Item [73], Assignee, replace "Telefonaktiebolaget LM Ericsson" with -- None --.

Signed and Sealed this

Nineteenth Day of February, 2002

*Attest:*

*Attesting Officer*

JAMES E. ROGAN
*Director of the United States Patent and Trademark Office*